US008268095B2

(12) United States Patent
Masuoka et al.

(10) Patent No.: US 8,268,095 B2
(45) Date of Patent: Sep. 18, 2012

(54) METHOD OF MANUFACTURING HOT DIP GALVANNEALED STEEL SHEET AND HOT DIP GALVANNEALED STEEL SHEET

(75) Inventors: Hiroyuki Masuoka, Hiroshima (JP); Shoichiro Taira, Hiroshima (JP); Yoshiharu Sugimoto, Okayama (JP); Naoto Yoshimi, Hiroshima (JP); Masayasu Nagoshi, Hiroshima (JP); Wataru Tanimoto, Hiroshima (JP)

(73) Assignee: JFE Steel Corporation, Tokyo (JP)

( * ) Notice: Subject to any disclaimer, the term of this patent is extended or adjusted under 35 U.S.C. 154(b) by 982 days.

(21) Appl. No.: 12/226,168

(22) PCT Filed: Apr. 26, 2007

(86) PCT No.: PCT/JP2007/059432

§ 371 (c)(1),
(2), (4) Date: Oct. 9, 2008

(87) PCT Pub. No.: WO2007/129678

PCT Pub. Date: Nov. 15, 2007

(65) Prior Publication Data

US 2009/0239063 A1 Sep. 24, 2009

(30) Foreign Application Priority Data

May 2, 2006 (JP) ..... 2006-128135
Jan. 26, 2007 (JP) ..... 2007-016282

(51) Int. Cl.
*C23C 22/48* (2006.01)
*C23C 22/05* (2006.01)

(52) U.S. Cl. ..... 148/247; 148/243; 148/276; 148/277; 148/280; 427/321; 428/432; 428/658; 428/659; 106/14.11

(58) Field of Classification Search ..... 148/247, 148/243, 276, 277, 280; 106/14.11; 427/321; 428/432, 658, 659
See application file for complete search history.

(56) References Cited

U.S. PATENT DOCUMENTS

2003/0175548 A1* 9/2003 Taira et al. ..... 428/659
(Continued)

FOREIGN PATENT DOCUMENTS

EP 1 288 325 A1 3/2003
(Continued)

OTHER PUBLICATIONS

Supplementary European Search Report dated Oct. 22, 2010 in EP 07 74 2867.

*Primary Examiner* — Lois Zheng
(74) *Attorney, Agent, or Firm* — Holtz Holtz Goodman & Chick PC

(57) ABSTRACT

A method of manufacturing a hot dip galvannealed steel sheet, including the steps of: subjecting a steel sheet to hot dip galvanizing to manufacture a hot dip galvanized steel sheet; heating the hot dip galvanized steel sheet for alloying; subjecting the hot dip galvanized steel sheet to temper rolling; bringing the temper-rolled hot dip galvanized steel sheet into contact with an acid solution containing at least one ion selected from the group consisting of Zr ions, Ti ions, and Sn ions to thereby form an acid solution film on the surface of the steel sheet; after completion of the contact, a state where the acid solution film is formed on the surface of the steel sheet is held for at least 1 second; and washing with water the hot dip galvanized steel sheet after holding, to thereby form a Zn oxide layer having a thickness of 10 nm or more on the surface of the galvanized steel sheet. The hot dip galvannealed steel sheet has an oxide layer having an average thickness of 10 nm or more on the surface of the plated steel sheet.

14 Claims, 2 Drawing Sheets

U.S. PATENT DOCUMENTS

2006/0185769 A1 * 8/2006 Nakayama et al. ..... 148/247

FOREIGN PATENT DOCUMENTS

| | | | |
|---|---|---|---|
| EP | 1 616 973 | A1 | 1/2006 |
| JP | 53-060332 | A | 5/1978 |
| JP | 01-319661 | A | 12/1989 |
| JP | 02-190483 | A | 7/1990 |
| JP | 03-191093 | A | 8/1991 |
| JP | 04-088196 | A | 3/1992 |
| JP | 2002-116026 | A | 4/2002 |
| JP | 2003-306781 | A | 10/2003 |
| JP | 2005/256042 | A | 9/2005 |

* cited by examiner

METHOD OF MANUFACTURING HOT DIP GALVANNEALED STEEL SHEET AND HOT DIP GALVANNEALED STEEL SHEET

This application is the United States national phase application of International Application PCT/JP2007/059432 filed Apr. 26, 2007.

TECHNICAL FIELD

The present invention relates to a method of manufacturing a hot dip galvannealed steel sheet exhibiting excellent press-forming properties even in a material which has high forming load and is likely to induce die galling, such as a high-strength hot dip galvannealed steel sheet, and the hot dip galvannealed steel sheet.

BACKGROUND ART

A hot dip galvannealed steel sheet is excellent in weldability and paintability as compared with a galvanized steel sheet which has not been subjected to alloying treatment, and thus is widely utilized in various fields, in particular, in application to car bodies. A hot dip galvannealed steel sheet for an application is press formed and used. However, a hot dip galvannealed steel sheet is disadvantageous in that a hot dip galvannealed steel sheet is inferior to a cold rolled steel sheet in press-forming properties. This is because the sliding resistance of a hot dip galvannealed steel sheet in a press die is high as compared with that of a cold rolled steel sheet. More specifically, it becomes difficult for the hot dip galvannealed steel sheet to flow into the press die at a portion where the sliding resistance between the die and a bead is high, resulting in the fact that the steel sheet is likely to break.

A hot dip galvannealed steel sheet refers to a sheet formed by galvanizing a steel sheet and then heating, and thus Fe in the steel sheet and Zn in a plated layer are dispersed to cause alloying reaction, whereby an Fe—Zn alloy phase is formed. The Fe—Zn alloy phase is a film generally containing a $\Gamma$ phase, a $\delta_1$ phase, and a $\zeta$ phase. There is a tendency that the hardness and the melting point decrease with a decrease in the Fe concentration in the order of the $\Gamma$ phase, the $\delta_1$ phase, and the $\zeta$ phase. Therefore, from the viewpoint of the sliding performance, a film having a high hardness and a high Fe concentration, for which a melting point is high and adhesion is likely to occur, is effective. The hot dip galvannealed steel sheet in which press-forming properties are regarded as important properties is manufactured in such a manner that the average Fe concentration of the film is high.

However, such a film having a high Fe concentration has problems in that the F phase, which is hard and vulnerable, is likely to be formed on the plating-steel sheet interface, and a phenomenon in which the film is separated from the interface, i.e., a so-called powdering, is likely to occur during processing. Therefore, in order to achieve both the sliding performance and powdering resistance, a method is employed which provides a hard Fe alloy as a second layer to an upper layer by electroplating or the like as disclosed in Patent Document 1.

As a method of improving the press-forming properties during the use of a galvanized steel sheet, a method of applying a lubricating oil having a high viscosity is widely used in addition to the above method. However, this method has problems in that coating defects may be caused by insufficient degreasing due to the high viscosity of a lubricating oil used in a coating process, the press performance becomes unstable due to the shortage of oil at the time of pressing, etc. Therefore, improvement of the press-forming properties of hot dip galvannealed steel sheets themselves has been strongly demanded.

As a method of solving the above-mentioned problems, Patent Documents 2 and 3 disclose techniques of subjecting the surface of a zinc steel sheet to electrolytic treatment, immersion treatment, coating oxidation treatment, or heat treatment to form an oxide film containing ZnO as a main component, to thereby improve the weldability and the processability.

Patent Document 4 discloses a technique of immersing a galvanized steel sheet in an aqueous solution containing 5 to 60 g/l of sodium phosphate and having a pH of 2 to 6, subjecting the surface of the plated steel sheet to electrolytic treatment, or applying the aqueous solution to the surface of the galvanized steel sheet to form an oxide film containing a P oxide as a main component on the surface of the galvanized steel sheet, to thereby improve press-forming properties and chemical conversion properties.

Patent Document 5 discloses a technique of subjecting the surface of a galvanized steel sheet to electrolytic treatment, immersion treatment, coating treatment, coating oxidation treatment, or heat treatment to form Ni oxide thereon, to thereby improve press-forming properties and chemical conversion properties.

Patent Document 6 discloses a technique of bringing a hot dip galvannealed steel sheet into contact with an acid solution to form an oxide containing Zn as a main component on the surface of the steel sheet, to thereby suppress the adhesion between a plated layer and a press die and improve the sliding performance.

Patent Document 1: Japanese Unexamined Patent Application Publication No. 1-319661

Patent Document 2: Japanese Unexamined Patent Application Publication No. 53-60332

Patent Document 3: Japanese Unexamined Patent Application Publication No. 2-190483

Patent Document 4: Japanese Unexamined Patent Application Publication No. 4-88196

Patent Document 5: Japanese Unexamined Patent Application Publication No. 3-191093

Patent Document 6: Japanese Unexamined Patent Application Publication No. 2002-116026

Technologies disclosed in Patent Documents 1 to 6 are effective for forming a hot dip galvannealed steel sheet having a relatively low hardness which is frequently used for automobile exterior panels. However, in a high-strength hot dip galvannealed steel sheet in which the contact pressure with a die increases due to high load at the time of press forming, an effect of improving the press-forming properties cannot be necessarily obtained stably.

DISCLOSURE OF INVENTION

The present invention aims to provide a method of manufacturing a hot dip galvannealed steel sheet exhibiting excellent press-forming properties even in a material which has high forming load and is likely to induce die galling, such as a high-strength hot dip galvannealed steel sheet, and the hot dip galvannealed steel sheet.

In order to solve the above-described problems, the present inventors have further conducted extensive researches. As a result, the following findings are obtained.

On the surface of the hot dip galvannealed steel sheet manufactured by the method of Patent Document 6, an oxide layer containing Zn as a main component is formed, and almost all the portion is formed on a temper-rolled part. In actual press forming, a surface which preferentially contacts a die is the temper-rolled part. When the contact pressure is low, the Zn oxide on the surface of the temper-rolled part suppresses a direct contact between the die and the surface of the plated layer, whereby the effect of improving press-forming properties is obtained. However, with an increase in the contact pressure, a direct contact between the die and a non-temper-rolled part needs to be dealt with in addition to the direct contact between the die and the temper-rolled part. In particular, when a high-strength steel sheet, such as a high-strength hot dip galvannealed steel sheet, is used, an oxide having a higher hardness needs to be formed on both the temper-rolled part and the non-temper-rolled part. In order to form a Zn oxide on both the temper-rolled part and the non-temper-rolled part, the present inventors found that it is effective to carry out treatment using, as an acid solution, a treatment solution containing Zr ions, Ti ions, or Sn ions.

The present invention has been accomplished based on the above findings, and the gist is as follows.

1. A method of manufacturing a hot dip galvannealed steel sheet, comprising the steps of:

subjecting a steel sheet to hot dip galvanizing to manufacture a hot dip galvanized steel sheet;

heating the hot dip galvanized steel sheet for alloying;

subjecting the hot dip galvanized steel sheet, which has been subjected to the alloying treatment, to temper rolling;

forming an acid solution film on the surface of the steel sheet by bringing the temper-rolled hot dip galvanized steel sheet into contact with an acid solution containing at least one of ions selected from the group consisting of Zr ions, Ti ions, and Sn ions;

after completion of the contact, holding a state where the acid solution film is formed on the surface of the steel sheet for at least 1 second; and washing the hot dip galvanized steel sheet with water after holding, to thereby form a Zn oxide layer having a thickness of 10 nm or more on the surface of the galvanized steel sheet.

2. The method of manufacturing a hot dip galvannealed steel sheet according to item 1, wherein the step of forming the acid solution film includes bringing the temper-rolled hot dip galvanized steel sheet into contact with an acid solution containing Zr ions to form an acid solution film on the surface of the steel sheet.

3. The method of manufacturing a hot dip galvannealed steel sheet according to item 2, wherein the acid solution contains at least one or more of Zr sulfate, Zr nitrate, Zr chloride, and Zr phosphate as a Zr ion concentration in the range of 0.1 to 50 g/l.

4. The method of manufacturing a hot dip galvannealed steel sheet according to item 1, wherein the step of forming the acid solution film includes bringing the temper-rolled hot dip galvanized steel sheet into contact with an acid solution containing Ti ions to form an acid solution film on the surface of the steel sheet.

5. The method of manufacturing a hot dip galvannealed steel sheet according to item 4, wherein the acid solution contains at least one or more of Ti sulfate, Ti nitrate, Ti chloride, and Ti phosphate as a Ti concentration in the range of 0.1 to 50 g/l.

6. The method of manufacturing a hot dip galvannealed steel sheet according to item 1, wherein the step of forming the acid solution film includes bringing the temper-rolled hot dip galvanized steel sheet into contact with an acid solution containing Sn ions to form an acid solution film on the surface of the steel sheet.

7. The method of manufacturing a hot dip galvannealed steel sheet according to item 6, wherein the acid solution contains at least one or more of Sn sulfate, Sn nitrate, Sn chloride, and Sn phosphate as an Sn ion concentration in the range of 0.1 to 50 g/l.

8. The method of manufacturing a hot dip galvannealed steel sheet according to item 1, wherein the acid solution film is 50 $g/m^2$ or lower.

9. The method of manufacturing a-hot dip galvannealed steel sheet according to item 1, wherein the acid solution film is in the range of 0.1 to 30 $g/m^2$.

10. The method of manufacturing a hot dip galvannealed steel sheet according to item 1, wherein the acid solution has a pH buffering effect and a degree of pH increase defined on the basis of an amount (1) of 1.0 mol/l sodium hydroxide solution required to raise the pH of 1 liter of acid solution from 2.0 to 5.0 is in the range of 0.05 to 0.5.

11. The method of manufacturing a hot dip galvannealed steel sheet according to item 1, wherein the acid solution contains at least one or more of acetate, phthalate, citrate, succinate, lactate, tartrate, borate, and phosphate in the range of 5 to 50 g/l in terms of the content of each component mentioned above; the pH is 0.5 to 2.0; and the temperature of the solution is 20 to 70° C.

12. The method of manufacturing a hot dip galvannealed steel sheet according to item 1, wherein the holding step includes holding a state where the acid solution film is formed on the surface of the steel sheet for 1 to 120 seconds after completion of the contact.

13. The method of manufacturing a hot dip galvannealed steel sheet according to item 12, wherein the holding step includes holding a state where the acid solution film is formed on the surface of the steel sheet surface for 1 to 30 seconds after completion of the contact.

14. The method of manufacturing a hot dip galvannealed steel sheet according to item 1, wherein the Zn oxide layer has an average thickness of 10 to 200 nm.

15. The method of manufacturing a hot dip galvannealed steel sheet according to item 14, wherein the Zn oxide layer has an average thickness of 10 to 100 nm.

16. A hot dip galvannealed steel sheet, which is a plated steel sheet manufactured by the method of manufacturing a hot dip galvannealed steel sheet according to claim 1, the sheet comprising:

an oxide layer being formed on the surface of the plated steel sheet, having an average thickness of 10 nm or more, and containing Zn and at least one element selected from the group consisting of Zr, Ti, and Sn.

17. The hot dip galvannealed steel sheet according to item 16, wherein the oxide layer contains Zn and Zr.

18. The hot dip galvannealed steel sheet according to item 16, wherein the oxide layer contains Zn and Ti.

19. The hot dip galvannealed steel sheet according to item 16, wherein the oxide layer contains Zn and Sn.

20. The hot dip galvannealed steel sheet according to item 16, wherein the Zn oxide layer has an average thickness of 10 to 200 nm.

21. The hot dip galvannealed steel sheet according to item 20, wherein the Zn oxide layer has an average thickness of 10 to 100 nm.

According to the present invention, in a high-strength hot dip galvannealed steel sheet in which the forming load is high and die galling is likely to occur, the sliding resistance at the time of press forming can be reduced and excellent press-forming properties can be achieved. Moreover, in the present invention, the hot dip galvannealed steel sheet excellent in the press-forming properties can be stably manufactured.

BEST MODES FOR CARRYING OUT THE INVENTION

Figure 1:
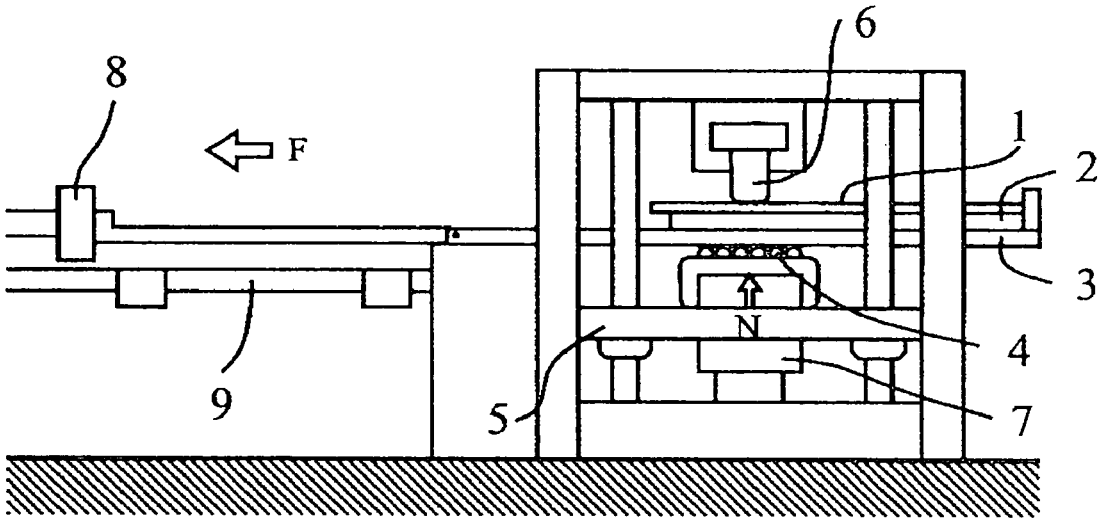
FIG. 1 is an outline front view of a friction coefficient measuring apparatus.

In the production of a hot dip galvannealed steel sheet, a steel sheet is galvannealed, and then heated for alloying. Due to the difference in the reactivity of the steel sheet-plating interface at the time of the alloying treatment, irregularities are present on the surface of the hot dip galvannealed steel sheet. However, after the alloying treatment, temper rolling is usually performed for securing a material, and due to the contact with a roll at the time of the temper rolling, the plated surface is smoothed and the irregularities are reduced. Therefore, at the time of press forming, force required for a die to crush convex portions on the plated surface decreases, thereby improving sliding performance.

When load at the time of press forming is low, a portion which the die directly contacts is a temper-rolled part of the surface of the hot dip galvannealed steel sheet. When load at the time of press forming becomes high, it is expected that a non-temper-rolled part of the surface of the steel sheet also directly contacts the die besides the contact between the temper-rolled part and the die. Therefore, in order to improve the sliding performance, it is important that a hard substance with a high melting point which prevents the adhesion with the die is present on the temper-rolled part and the non-temper-rolled part on the surface of the hot dip galvannealed steel sheet. In this respect, the presence of an oxide layer on the surface of the steel sheet is effective for improving the sliding performance because the oxide layer prevents the adhesion with the die.

In actual press forming, the oxide on a surface layer is worn out and shaved off. Therefore, when the contact area of the die and a work piece is large, a sufficiently thick oxide layer needs to be present. Moreover, although an oxide is formed on the surface of a plated layer by heating at the time of alloying treatment, almost all the portion thereof is broken due to the contact with the roll at the time of temper rolling, and thus a regenerated surface is exposed. Thus, in order to obtain favorable sliding performance, a thick oxide layer needs to be formed before temper rolling. However, even when a thick oxide layer is formed before temper rolling considering the above, the breakage of the oxide layer occurring at the time of temper rolling cannot be avoided. Therefore, the oxide layer on the surface of the plating layer is inhomogeneously present, and the favorable sliding performance cannot be stably obtained.

Therefore, by subjecting the temper-rolled hot dip galvannealed steel sheet, especially the surface of the plated steel sheet, to treatment for uniformly forming an oxide layer thereon, favorable sliding performance can be stably obtained.

By bringing the temper-rolled hot dip galvannealed steel sheet into contact with an acid solution, holding a state where an acid solution film is formed on the surface of the steel sheet for a given time, washing the resultant with water, and drying the washed substance, an oxide layer can be formed on the plated surface layer. During the process, with respect to the oxide to be formed, an oxide layer containing Zn as a main component is formed mainly on the temper-rolled part on the surface of the plated steel sheet. In a hot dip galvannealed steel sheet with a relatively low hardness which is used for automobile exterior panels, the forming load is low. Therefore, a portion which directly contacts the die at the time of press forming is mainly the temper-rolled part on the surface of the plated layer. Thus, by forming the oxide layer on the temper-rolled part on the surface of the plated layer, favorable press-forming properties are obtained. However, since a hot dip galvannealed steel sheet with a high hardness which is used for a structural member has high forming load, there is a possibility that the die directly contacts not only the temper-rolled part but also the non-temper-rolled part at the time of press forming. Therefore, simply by forming an oxide layer only on the temper-rolled part, favorable press-forming properties cannot be secured.

EMBODIMENT 1

When an acid solution containing Zr is used, an oxide layer containing Zn and Zr can be formed on a temper-rolled part and a non-temper-rolled part. Since Zr is harder than Zn, a harder oxide layer can be formed as compared with an oxide layer of a Zn simple substance. The oxide layer thus formed is not easily broken even when the contact pressure with the die is high, and suppresses direct contact between the die and the surface of the plated layer. As a result, favorable press-forming properties are exhibited even in a high-strength hot dip galvannealed steel sheet which has high forming load and is likely to induce die galling.

Although, the mechanism of the oxide layer formation is not clearly understood, it may be considered in the following way. When a hot dip galvannealed steel sheet is brought into contact with an acid solution, the dissolution of zinc occurs from the side of the steel sheet. Simultaneously with the dissolution of zinc, hydrogen is generated. Therefore, with the advance of the dissolution of zinc, the hydrogen ion concentration of the acid solution decreases. As a result, the pH of the acid solution increases to reach a pH range where an oxide (hydroxide) is stabilized, and thus an oxide layer is formed on the surface of the hot dip galvannealed steel sheet. In this case, when an acid solution containing Zr is used, formation reaction of Zr oxide occurs in a pH range lower than a pH range in which formation reaction of Zn oxide occurs, and thereafter, when the pH further increases, formation reaction of Zn oxide occurs. Therefore, formation reaction of an oxide easily occurs as compared with the case of using a Zn simple substance. Moreover, considering the fact that the formation reaction of Zr oxide occurs in a low pH range, the steel sheet is strongly etched, and the formation reaction of oxide easily occurs also in the non-temper-rolled part whose reactivity is inferior to that of the temper-rolled part. Moreover, since the method of forming an oxide described above progresses while slightly dissolving the surface of the plated layer, favorable adhesiveness is also achieved as compared with a layer obtained by coating treatment using a solvent in which an oxide has been dispersed. Moreover, since the precipitation reaction of a hydroxide is utilized, a thick film can be formed as compared with a film obtained by completely coating the surface by heat treatment or the like. It should be noted that when the steel sheet is brought into contact with an acid solution, and then held for at least 1 second after completion of the contact, the steel sheet may be heated by induction heating, radiation heating, etc.

As described above, in the present invention, by hot dip galvannealing a steel sheet, heating the resultant for further alloying, subjecting the resultant to temper rolling, bringing the resultant into contact with an acid solution, holding the resultant for at least 1 second after completion of the contact, and then washing the resultant with water, Zr ions are incorporated into the acid solution when a Zn oxide layer having a thickness of 10 nm or more is formed on the surface of the galvanized steel sheet. This is the most important requirement in the present invention.

In order to incorporate Zr ions into the acid solution, it is preferable to contain at least one or more of Zr sulfate, Zr nitrate, Zr chloride, and Zr phosphate as a Zr ion concentration in the range of 0.1 to 50 g/l. When the Zr ion concentration is lower than 0.1 g/l, the amount of the Zr oxide to be formed is small and an oxide layer mainly containing Zn is formed. Therefore, an effect of improving the press-forming properties when the contact pressure increases may not be sufficiently obtained in some cases. In contrast, when the Zr ion concentration exceeds 50 g/l, the proportion of Zr oxide formed is high, which is effective for improving the sliding performance. However, the Zr oxide tends to deteriorate the compatibility with adhesives designed for the hot dip galvannealed steel sheet.

It is preferable to use an acid solution exhibiting a pH buffering effect in the pH range of 2.0 to 5.0. This is because when the acid solution exhibiting a pH buffering effect in the pH range of 2.0 to 5.0 is used, dissolution of Zn and formation reaction of the Zr oxide and the Zn oxide due to reaction between the acid solution and the plated layer sufficiently occur as a result of bringing the steel sheet into contact with the acid solution, and then holding it there for a given period of time, and thus an oxide layer can be stably obtained on the surface of the steel sheet. The index of such a pH buffering effect can be evaluated on the basis of the degree of pH increase defined by the amount (1) of 1.0 mol/l sodium hydroxide solution required to raise the pH of 1 liter of acid solution from 2.0 to 5.0, and the value may be in the range of 0.05 to 0.5. The reason for this is due to the following facts. When the degree of pH increase is lower than 0.05, the pH promptly increases and thus the dissolution of zinc sufficient for the formation of an oxide cannot be achieved, resulting in the fact that a sufficient oxide layer may not be formed in some cases. In contrast, when the degree of pH increase exceeds 0.5, the dissolution of zinc is promoted and it takes a long time to form an oxide layer, and moreover the plated layer is seriously damaged, which results in the fact that that the original function of the steel sheet as a rust preventive steel sheet may be lost. It should be noted that the degree of PH increase is evaluated after an inorganic acid having negligible buffering properties in the pH range of 2.0 to 5.0 is added to an acid solution whose pH exceeds 2.0 to thereby reduce the pH to 2.0.

Mentioned as the acid solution having pH buffering properties are acetate, such as sodium acetate ($CH_3COONa$); phthalate, such as potassium hydrogen phthalate ($(KOOC)_2C_6H_4$); citrate, such as sodium citrate ($Na_3C_6H_5O_7$) or potassium dihydrogen citrate ($KH_2C_6H_5O_7$); succinate, such as sodium succinate ($Na_2C_4H_4O_4$); lactate, such as sodium lactate ($NaCH_3CHOHCO_2$); tartrate, such as sodium tartrate ($Na_2C_4H_4O_6$) borate; or phosphate. It is preferable to use an aqueous solution containing at least one or more thereof in such a manner as to be in the range of 5 to 50 g/l in terms of the content of each component mentioned above. When the concentration is lower than 5 g/l, the pH relatively promptly increases simultaneously with the dissolution of zinc, and thus an oxide layer sufficient for the improvement of the sliding performance cannot be formed. In contrast, when the concentration exceeds 50 g/l, the dissolution of zinc is promoted and it takes a long time to form an oxide layer, and moreover the plated layer is seriously damaged, which results in the original function of the steel sheet as a rust preventive steel sheet being lost.

It is preferable that the pH of the acid solution be in the range of 0.5 to 2.0. This is because when the pH exceeds 2.0, the deposition (formation of a hydroxide) of Zr ions occurs in the solution, and thus a Zr oxide is not incorporated in an oxide layer. In contrast, when the pH is too low, the dissolution of zinc is promoted, and moreover not only does the plating coating weight decrease but also the plating film is cracked, resulting in the fact that the separation is likely to occur in processing. Therefore, it is preferable that the pH is 0.5 or more. It should be noted that when the pH of the acid solution is higher than the range of 0.5 to 2.0, the pH can be adjusted with an inorganic acid having no pH buffering properties, such as sulfuric acid.

It is preferable that the temperature of the acid solution be in the range of 20 to 70° C. When the temperature is lower than 20° C., the formation reaction of an oxide layer takes a long time, sometimes resulting in lowering of productivity. In contrast, when the temperature is high, the reaction relatively rapidly progresses, but, in contrast, treatment unevenness is likely to occur on the surface of the steel sheet. Therefore, it is preferable to control the temperature to be 70° C. or lower.

It should be noted that, in the present invention, when Zr ions are contained in an acid solution to be used, an oxide layer excellent in sliding performance can be stably formed. Therefore, even when other metal ions, inorganic compounds, etc., are contained as impurities or intentionally contained in the acid solution, the effect of the present invention is not impaired. In particular, since Zn ions are eluted when the steel sheet and the acid solution are brought into contact with each other, the increase in the Zn concentration of the acid solution is recognized during operation. However, the degree of the concentration of Zn ions does not particularly affect the effect of the present invention.

As described above, on the surface of the plated steel sheet of the present invention, an at least 10 nm thick oxide layer containing Zn and Zr as an essential component is obtained.

There is no limitation on the method to be used for bringing a hot dip galvannealed steel sheet into contact with an acid solution. Examples include a method of immersing a plated steel sheet in an acid solution, a method of spraying an acid solution onto a plated steel sheet, a method of applying an acid solution to a plated steel sheet using a spreader roll, etc. It is preferable that the acid solution is finally present on the surface of the steel sheet in the form of a thin liquid film. This is because when the amount of the acid solution present on the surface of the steel sheet is large, the following problems arise: even when zinc dissolves, the pH of the solution does not increase, and the dissolution of zinc merely successively occurs; it takes a long time to form an oxide layer; the steel sheet is seriously damaged; and the original function of the steel sheet as a rust preventive steel sheet is lost. From the viewpoint described above, adjusting the amount of the solution forming a film on the surface of the steel sheet to be 50 $g/m^2$ or lower is preferable and effective. It should be noted that the amount of the solution forming a film can be adjusted by using drawing rolls, by air wiping, etc.

Moreover, it is preferable that a period of time until washing with water is performed after contacting the acid solution (holding time until washing with water is performed) be 1 to 120 seconds. The reason for this is due to the following facts. When the period of time until washing with water is performed is lower than 1 second, the pH of the solution increases, and the acid solution is washed away before the Zr oxide layer and the Zn oxide layer are formed, resulting in the fact that an effect of improving sliding performance is not obtained. When the time exceeds 120 seconds, the amount of the oxide layer does not change. The period of time until washing with water is performed after contacting the acid solution is more preferably 1 to 30 seconds.

It should be noted that the oxide layer in the present invention refers to a layer formed of, for example, an oxide and/or a hydroxide containing Zn and Zr as an essential component. It is required that the average thickness of such an oxide layer containing Zn and Zr as an essential component is 10 nm or more on the surface layer of the temper-rolled part and on the surface layer of the non-temper-rolled part. When the average thickness of the oxide layer becomes as thin as 10 nm or lower on the temper-rolled part and the non-temper-rolled part, an effect of reducing sliding resistance becomes insufficient. In contrast, when the average thickness of the oxide layer containing Zn and Zr as an essential component exceeds 200 nm on the temper-rolled part and the non-temper-rolled part, there is a tendency that the film is broken in pressing, and thus the sliding resistance increases and the weldability decreases. Thus, such an average thickness is not preferable. The average thickness is more preferably 10 to 100 nm.

When the hot dip galvannealed steel sheet of the present invention is manufactured, Al needs to be added to a plating bath, and additional elements other than Al are not limited. More specifically, even when Pb, Sb, Si, Sn, Mg, Mn, Ni, Ti, Li, Cu, etc., other than Al are contained or added, the effect of the present invention is not impaired.

Furthermore, even when S, N, Pb, Cl, Na, Mn, Ca, Mg, Ba, Sr, Si, etc., are incorporated into an oxide layer due to the presence of an impurity in a treatment solution used for oxidation treatment or the like, the effect of the present invention is not impaired.

EXAMPLE

Hereinafter, the present invention will be described in more detail with reference to Examples.

On a cold rolled steel sheet having a plate thickness of 0.8 mm, a hot dip galvannealed film according to a routine manner was formed, and furthermore temper rolling was performed. Subsequently, as oxide formation treatment, the resultant was immersed, for 3 seconds, in an aqueous acid solution of 40 g/l of sodium acetate in which the Zr ion concentration and the temperature of the solution were suitably changed. Thereafter, roll drawing was performed to adjust the solution amount. Then, the resultant was held at room temperature in air for 1 to 60 seconds, sufficiently washed with water, and then dried.

Next, the steel sheet produced as described above was measured for the film thickness of the oxide layer on the temper-rolled part and the non-temper-rolled part of a plated surface layer, and simultaneously the friction coefficient was measured as a measure of simply evaluating press-forming properties. The measurement method is as follows.

Evaluation Test of Sliding Performance (Measurement Test of Friction Coefficient)

In order to evaluate press-forming properties, the friction coefficient of each sample was measured as follows.

FIG. 1 is an outline front view of a friction coefficient measuring apparatus. As illustrated in FIG. 1, a friction coefficient measurement test sample 1 extracted from a sample is fixed to a sample stand 2. The sample stand 2 is fixed to the upper surface of a slide table 3 capable of horizontally moving. On the under surface of the slide table 3 is provided a slide table support 5 which has a roller 4 in contact with the under surface of the slide table 3 and which can move up and down. The slide table support 5 is provided with a first load cell 7 for measuring a pressing load N applied to the friction coefficient measurement test sample 1 by a bead 6 By pushing up. A second load cell 8 for measuring a sliding resistance force F for horizontally transferring the slide table 3 in a state where the pressing force is being applied is attached to one end of the slide table 3. It should be noted that the test was performed by applying, as a lubricating oil, a press treated oil PRETON R352L, manufactured by SUGIMURA Chemical Industrial Co. Ltd., to the surface of a sample 11.

Figure 2:
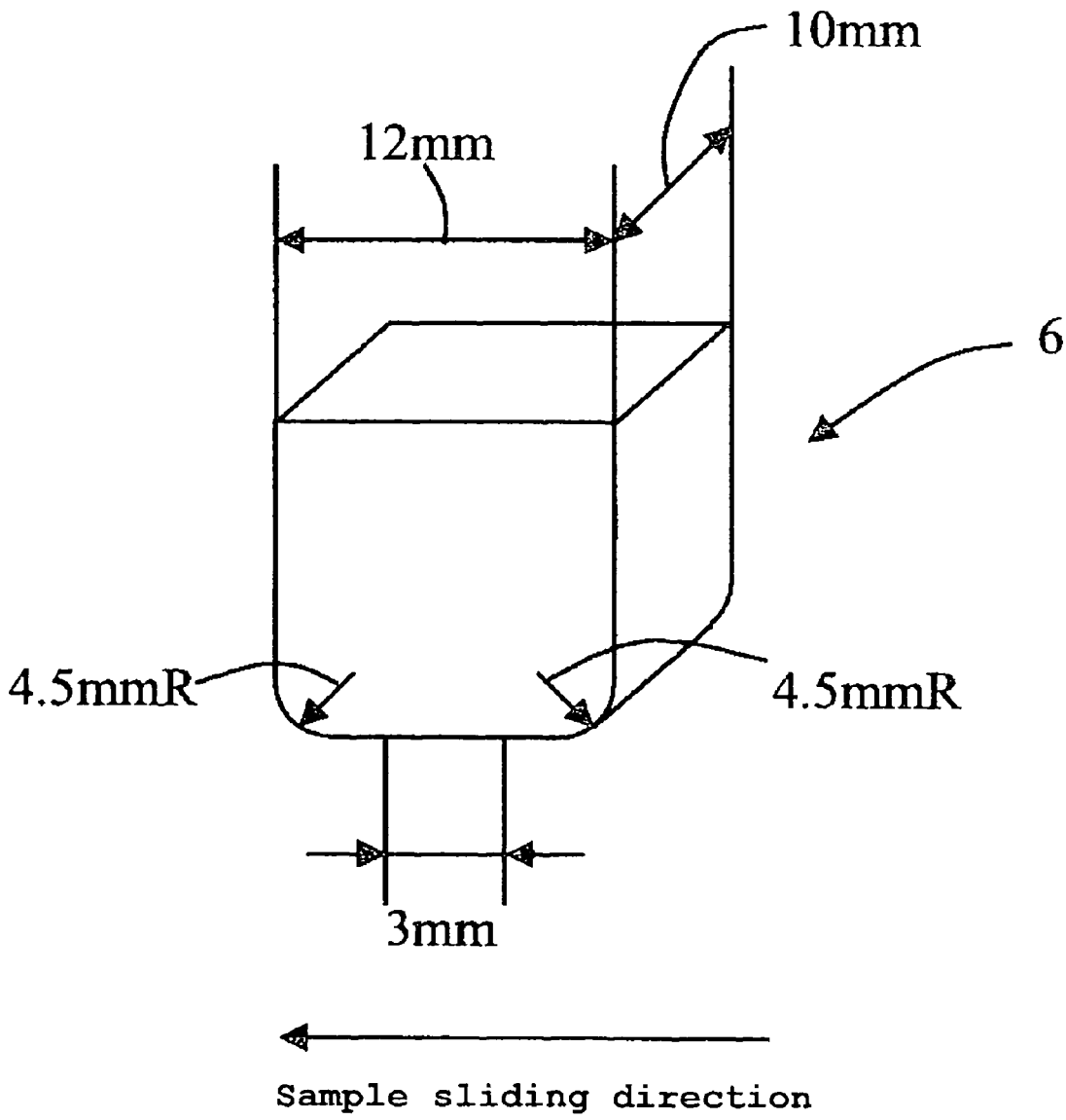
FIG. 2 is an outline perspective view illustrating the shape and the dimension of a bead in FIG. 1.

FIG. 2 is an outline perspective view illustrating the shape and the dimension of the bead used. The bead 6 slides while the under surface of the bead 6 is being pressed against the surface of the friction coefficient measurement test sample 1. With respect to the shape of the bead 6 shown in FIG. 2, the width is 10 mm; the length of the sample in the sliding direction is 12 mm; a lower part at each end in the sliding direction is formed of a curved surface having a curvature of 4.5 mmR; and the under surface of the bead 6 against which the sample is pressed has a flat surface having a width of 10 mm and a length in the sliding direction of 3 mm.

The measurement of the friction coefficient was performed at room temperature (25° C.) while changing the pressing load N from 400 kgf to 1500 kgf, assuming a severe pressing environment in a high-strength hot dip galvannealed steel sheet which has high forming load and is likely to induce mold galling. It should be noted that the drawing rate (horizontally moving rate of the slide table 3) of the sample was 100 cm/min. Under these conditions, the pressing load N and the drawing load F were measured, and the friction coefficient μ between the sample and the bead was calculated according to the equation: $\mu=F/N$.

Measurement of Oxide Film Thicknesses

The content (at. %) of each element was measured for the temper-rolled part and the non-temper-rolled part of the plated surface layer by Auger electron spectroscopy (AES). Subsequently, Ar spattering was performed to reach a predetermined depth, and then the content of each element in the plated film was measured by AES. By repeating this process, the composition distribution of each element in the depth direction was measured. The depth at which the rate of content of O originating from an oxide and a hydroxide becomes ½ of the sum of the maximum value and a fixed value of the rate of content of O at a position deeper than the position of the maximum value was defined as the thickness of the oxide. The thickness of the oxide was measured at two portions in each of the temper-rolled part and the non-temper-rolled part. An average value of the two measurement values of the temper-rolled part and an average value of the two measurement values of the non-temper-rolled part were defined as the thickness of the oxide of the temper-rolled part and the thickness of the non-temper-rolled part, respectively. It should be noted that Ar sputtering was performed for 30 seconds as preliminary treatment to remove a contamination layer on the surface of the sample.

The test results obtained in the above are shown in Table 1. It should be noted that, in Table 1, the condition 1 refer to that a pressing load was 400 kgf and a sample temperature was 25° C. (room temperature) and the condition 2 refer to that a pressing load was 1500 kgf and a sample temperature was 25° C. (room temperature), respectively.

TABLE 1

| Sample No. | Solution pH buffering agent | Solution Zr concentration | Degree of pH elevation | Solution Temperature | Liquid film quantity ($g/m^2$) | Time until washing with water | Oxide film thickness (nm) Pressure controlled part | Oxide film thickness (nm) Pressure not-controlled part | Friction coefficient Condition 1 | Friction coefficient Condition 2 | Remarks |
|---|---|---|---|---|---|---|---|---|---|---|---|
| 1 | — | — | 0.24 | — | — | — | 8.3 | 5.6 | 0.167 | 0.351 | Com. Ex. 1 |
| 2 | Sodium | — | 0.24 | 25° C. | 3 | 5 sec. | 23.1 | 9.8 | 0.138 | 0.145 | Com. Ex. 2 |
| 3 | acetate | | | | 3 | 10 sec. | 31.1 | 12.3 | 0.136 | 0.142 | Com. Ex. 3 |
| 4 | 40 g/l | | | | 3 | 30 sec. | 41.9 | 15.6 | 0.130 | 0.136 | Com. Ex. 4 |
| 5 | | 0.1 g/l | 0.25 | 25° C. | 3 | 5 sec. | 25.5 | 13.3 | 0.130 | 0.080 | Example 1 |
| 6 | | | | | 3 | 10 sec. | 42.5 | 20.3 | 0.128 | 0.079 | Example 2 |
| 7 | | | | | 3 | 30 sec. | 62.2 | 37.1 | 0.126 | 0.077 | Example 3 |
| 8 | | 3.5 g/l | 0.28 | 25° C. | 3 | 5 sec. | 33.6 | 17.5 | 0.129 | 0.079 | Example 4 |
| 9 | | | | | 3 | 10 sec. | 49.8 | 22.1 | 0.126 | 0.077 | Example 5 |
| 10 | | | | | 3 | 30 sec. | 83.0 | 42.2 | 0.121 | 0.074 | Example 6 |
| 11 | | 35 g/l | 0.32 | 15° C. | 3 | 5 sec. | 31.6 | 13.8 | 0.141 | 0.082 | Example 7 |
| 12 | | | | | 3 | 10 sec. | 40.8 | 19.8 | 0.138 | 0.081 | Example 8 |
| 13 | | | | | 3 | 30 sec. | 54.3 | 26.6 | 0.135 | 0.078 | Example 9 |
| 14 | | | | 25° C. | 3 | 5 sec. | 9.8 | 7.4 | 0.162 | 0.349 | Com. Ex. 5 |
| 15 | | | | | 3 | 10 sec. | 21.3 | 10.8 | 0.125 | 0.072 | Example 10 |
| 16 | | | | | 3 | 30 sec. | 41.2 | 25.8 | 0.124 | 0.072 | Example 11 |
| 17 | | | | | 3 | 5 sec. | 59.9 | 40.4 | 0.121 | 0.070 | Example 12 |
| 18 | | | | | 3 | 10 sec. | 90.1 | 42.5 | 0.119 | 0.069 | Example 13 |
| 19 | | | | | 3 | 30 sec. | 91.1 | 42.5 | 0.119 | 0.067 | Example 14 |
| 20 | | | | | 5 | 5 sec. | 38.3 | 22.1 | 0.130 | 0.075 | Example 15 |
| 21 | | | | | 5 | 10 sec. | 56.3 | 34.5 | 0.128 | 0.074 | Example 16 |
| 22 | | | | | 5 | 30 sec. | 85.6 | 39.7 | 0.125 | 0.072 | Example 17 |
| 23 | | | | 50° C. | 3 | 5 sec. | 43.9 | 27.2 | 0.122 | 0.071 | Example 18 |
| 24 | | | | | 3 | 10 sec. | 62.1 | 32.4 | 0.120 | 0.070 | Example 19 |
| 25 | | | | | 3 | 30 sec. | 92.1 | 45.0 | 0.116 | 0.067 | Example 20 |
| 26 | | | | 75° C. | 3 | 5 sec. | 45.6 | 28.6 | 0.121 | 0.070 | Example 21 |
| 27 | | | | | 3 | 10 sec. | 60.9 | 35.6 | 0.117 | 0.068 | Example 22 |
| 28 | | | | | 3 | 30 sec. | 97.0 | 52.1 | 0.114 | 0.066 | Example 23 |
| 29 | | 50 g/l | 0.34 | 25° C. | 3 | 5 sec. | 33.6 | 17.4 | 0.122 | 0.071 | Example 24 |
| 30 | | | | | 3 | 10 sec. | 62.6 | 30.0 | 0.122 | 0.071 | Example 25 |
| 31 | | | | | 3 | 30 sec. | 98.9 | 52.3 | 0.120 | 0.070 | Example 26 |

The following matters are clarified from the test results shown in Table 1.

Since Sample No. 1 of Comparative Example was not treated with an acid solution, an oxide film sufficient for improving the sliding performance is not formed on the temper-rolled part and the non-temper-rolled part, and the friction coefficient is high also under the condition 1 in which the contact pressure is low. Moreover, under the condition 2 in which the contact pressure is high, the friction coefficient further increases and mold galling occurs. Samples No. 2 to 4 of Comparative Examples are comparative examples which were treated with an acid solution but in which a bath containing no Zr ions was used. In this case, an oxide layer containing Zn as a main component is formed mainly on the temper-rolled part on the surface of a plated steel sheet. Therefore, an effect of improving the friction coefficient under the condition 1 is observed in which the contact pressure is low and thus the contact with a die occurs mainly on the temper-rolled part at the time of forming. However, the friction coefficient is high under the condition 2 in which the contact pressure is high and thus the contact with the die occurs over the temper-rolled part and the non-temper-rolled part.

In contrast, Samples No. 5 to 31 are examples using a bath containing Zr ions. In this case, in the examples of the present invention, excluding Sample No. 14 which was washed with water without holding, a hard oxide layer containing Zn and Zr is formed on the temper-rolled part and the non-temper-rolled part on the surface of a plated steel sheet. Therefore, the friction coefficient is stable at a low level also under the condition 2 in which the contact pressure is high in addition to the condition 1 in which the contact pressure is low.

Samples No. 5 to 7 are examples of the present invention which were treated with an acid solution containing Zr ions, and the friction coefficient decreases also in the condition 2 in which the contact pressure is high in addition to the condition 1 in which the contact pressure is low. Moreover, Samples No. 8 to 10, 16 to 18, and 29 to 31 are examples of the present invention in which the Zr ion concentration was increased under the same treatment conditions as in Samples No. 5 to 7. Under any conditions, the friction coefficient is stable at a low level.

Samples No 14 to 19 are examples of the present invention in which an acid solution film was formed on the surface of a steel sheet and the period of time until washing with water was performed was changed. In Sample No. 14 of the comparative example in which washing with water was performed without holding, an oxide film sufficient for improving the sliding performance is not formed on the temper-rolled part and the non-temper-rolled part, and the friction coefficient increases also under the condition 2 in which the contact pressure is high in addition to the condition 1 in which the contact pressure is low. In samples No. 15 to 19 in which the holding time is 1 second, the friction coefficient is stable at a low level.

Samples No. 11 to 13 and 23 to 28 are examples of the present invention in which the temperature of the treatment solution was changed, and an effect of improving the friction coefficient is sufficient also under the condition 2 in which the contact pressure is high in addition to the condition 1 in which the contact pressure is low. However, the production thereof requires a facility with high heat resistance and the amount of evaporation of the solution increases in the production thereof, which makes it somewhat difficult to control the liquid film quantity.

Samples No. 20 to 22 are examples of the present invention in which the liquid film formation quantity was changed relative to Sample No. 16 to 18. Comparison between the samples having the same holding time until washing with water was performed showed that the pH of the solution is hard to increase and an oxide layer is hard to be formed when the amount of the solution is small, as compared with the case where the liquid film quantity is large, and thus the friction coefficient is slightly high under the condition 1 in which the contact pressure is low and the condition 2 in which the contact pressure is high.

EMBODIMENT 2

When an acid solution containing Ti is used, an oxide layer containing Zn and Ti can be formed on a temper-rolled part and a non-temper-rolled part. Since Ti is harder than Zn, a harder oxide layer can be formed as compared with an oxide layer of a Zn simple substance. The oxide layer thus formed is not easily broken even when the contact pressure with the die is high, and suppresses the direct contact between the die and the surface of the plated layer. As a result, favorable press-forming properties are exhibited even in a high-strength hot dip galvannealed steel sheet which has high forming load and is likely to induce die galling.

The mechanism of the oxide layer formation is not clear, but the mechanism can be understood as follows. When a hot dip galvannealed steel sheet is brought into contact with an acid solution, the dissolution of zinc occurs from the side of the steel sheet. Simultaneously with the dissolution of zinc, hydrogen is generated. Therefore, with the advance of the dissolution of zinc, the hydrogen ion concentration of the acid solution decreases. As a result, the pH of the acid solution increases to reach a pH range where an oxide (hydroxide) is stabilized, and thus an oxide layer is formed on the surface of the hot dip galvannealed steel sheet. In this case, when an acid solution containing Ti is used, formation reaction of Ti oxide occurs in a pH range lower than a pH range in which formation reaction of Zn oxide occurs, and thereafter, when the pH further increases, formation reaction of Zn oxide occurs. Therefore, formation reaction of an oxide easily occurs as compared with the case of using a Zn simple substance. Moreover, considering the fact that the formation reaction of Ti oxide occurs in a low pH range, the steel sheet is strongly etched, and the formation reaction of oxide easily occurs also in the non-temper-rolled part whose reactivity is inferior to that of the temper-rolled part. Moreover, since the method of forming an oxide described above progresses while slightly dissolving the surface of the plated layer, favorable adhesiveness is also achieved as compared with a layer obtained by coating treatment using a solvent in which an oxide has been dispersed. Moreover, since the precipitation reaction of a hydroxide is utilized, a thick film can be formed as compared with a film obtained by completely coating the surface by heat treatment or the like. It should be noted that when the steel sheet is brought into contact with an acid solution, and then held for 1 to 30 seconds after completion of the contact, the steel sheet may be heated by induction heating, radiation heating, etc.

As described above, in the present invention, by hot dip galvannealing a steel sheet, heating the resultant for further alloying, subjecting the resultant to temper rolling, bringing the resultant into contact with an acid solution, holding the resultant for at least 1 second after completion of the contact, and then washing the resultant with water, Ti ions are incorporated in the acid solution when a Zn oxide layer having a thickness of 10 nm or more is formed on the surface of the galvanized steel sheet. This is the most important requirement in the present invention.

In order to incorporate Ti ions in the acid solution, it is preferable to contain at least one or more of Ti sulfate, Ti nitrate, Ti chloride, and Ti phosphate as a Ti ion concentration in the range of 0.1 to 50 g/l. When the Ti ion concentration is lower than 0.1 g/l, the amount of the Ti oxide to be formed is small and an oxide layer mainly containing Zn is formed. Therefore, an effect of improving the press-forming properties when the contact pressure increases may not be sufficiently obtained in some cases. In contrast, when the Ti ion concentration exceeds 50 g/l, the proportion of Ti oxide to be formed is high, which is effective for improving the sliding performance. However, the Ti oxide tends to deteriorate the compatibility with adhesives designed for the hot dip galvannealed steel sheet.

It is preferable to use an acid solution exhibiting a pH buffering effect in the pH range of 2.0 to 5.0. This is because when the acid solution exhibiting a pH buffering effect in the pH range of 2.0 to 5.0 is used, dissolution of Zn and formation reaction of the Ti oxide and the Zn oxide due to reaction between the acid solution and the plated layer sufficiently occur by bringing the steel sheet into contact with the acid solution, and then holding for a given time, and thus an oxide layer can be stably obtained on the surface of the steel sheet. The index of such a pH buffering effect can be evaluated by the degree of pH increase defined by the amount (1) of 1.0 mol/l sodium hydroxide solution required to raise the pH of 1 liter of acid-solution from 2.0 to 5.0, and the value may be in the range of 0.05 to 0.5. The reason is based on the following facts. When the degree of pH increase is lower than 0.05, the pH promptly increases and thus the dissolution of zinc sufficient for the formation of an oxide cannot be achieved, resulting in the fact that a sufficient oxide layer may not be formed in some cases. In contrast, when the degree of pH increase exceeds 0.5, the dissolution of zinc is promoted and it takes a long time to form an oxide layer, and moreover the plated layer is seriously damaged, which results in the fact that the original function as a rust preventive steel sheet may be lost. It should be noted that the degree of PH increase is evaluated after an inorganic acid having few buffering properties in the pH range of 2.0 to 5.0 is added to an acid solution whose pH exceeds 2.0 to thereby reduce the pH to 2.0.

Mentioned as the acid solution having pH buffering properties are acetate, such as sodium acetate ($CH_3COONa$); phthalate, such as potassium hydrogen phthalate ($(KOOC)_2C_6H_4$); citrate, such as sodium citrate ($Na_3C_6H_5O_7$) and potassium dihydrogen citrate ($KH_2C_6H_5O_7$); succinate, such as sodium succinate ($Na_2C_4H_4O_4$); lactate, such as sodium lactate ($NaCH_3CHOHCO_2$); tartrate, such as sodium tartrate ($Na_2C_4H_4O_6$); borate; and phosphate. It is preferable to use an aqueous solution containing at least one or more thereof in such a manner as to be in the range of 5 to 50 g/l in terms of the content of each component mentioned above. When the concentration is lower than 5 g/l, the pH relatively promptly increases simultaneously with the dissolution of zinc, and thus an oxide layer sufficient for the improvement of the sliding performance cannot be formed. In contrast, when the concentration exceeds 50 g/l, the dissolution of zinc is promoted and it takes a long time to form an oxide layer, and moreover the plated layer is seriously damaged, which results in the fact that the original function as a rust preventive steel sheet may be lost.

It is preferable that the pH of the acid solution be in the range of 0.5 to 2.0. This is because when the pH exceeds 2.0, the deposition (formation of a hydroxide) of Ti ions occurs in the solution, and thus a Ti oxide is not incorporated in an oxide layer. In contrast, when the pH is too low, the dissolution of zinc is promoted, and moreover not only that the plating coating weight decreases but also that the plating film is cracked, resulting in the fact that the separation is likely to occur in processing. Therefore, it is preferable that the pH is 0.5 or more. It should be noted that when the pH of the acid solution is higher than the range of 0.5 to 2.0, the pH can be adjusted with an inorganic acid having no pH buffering properties, such as sulfuric acid.

It is preferable that the temperature of the acid solution be in the range of 20 to 70° C. When the temperature is lower than 20° C., the formation reaction of an oxide layer takes a long time, sometimes resulting in lowering of productivity. In contrast, when the temperature is high, the reaction relatively rapidly progresses, but, on the contrary, treatment unevenness is likely to occur on the surface of the steel sheet. Therefore, it is preferable to control the temperature to be 70° C. or lower.

It should be noted that, in the present invention, when Ti ions are contained in an acid solution to be used, an oxide layer excellent in sliding performance can be stably formed. Therefore, even when other metal ions, inorganic compounds, etc., are contained as impurities or intentionally contained in the acid solution, the effect of the present invention is not impaired. In particular, since Zn ions are eluted when the steel sheet and the acid solution are brought into contact with each other, the increase in the Zn concentration of the acid solution is recognized during operation. However, the degree of the concentration of Zn ions does not particularly affect the effect of the present invention.

As described above, on the surface of the plated steel sheet of the present invention, an at least 10 nm thick oxide layer containing Zn and Ti as an essential component is obtained.

There is no limitation on the method of bringing a hot dip galvannealed steel sheet into contact with an acid solution. Mentioned are a method of immersing a plated steel sheet in an acid solution, a method of spraying an acid solution to a plated steel sheet, a method of applying an acid solution to a plated steel sheet using a spreader roll, etc. It is preferable that the acid solution is finally present on the surface of the steel sheet in the form of a thin liquid film. This is because when the amount of the acid solution present on the surface of the steel sheet is large, the following problems arise: even when zinc dissolves, the pH of the solution does not increase, and the dissolution of zinc merely successively occurs; it takes a long time to form an oxide layer; the steel sheet is seriously damaged; and the original function as a rust preventive steel sheet is lost. From the viewpoint described above, adjusting the amount of the solution forming a film on the surface of the steel sheet be adjusted to 50 g/m$^2$ or lower is preferable and effective. It should be noted that the amount of the solution forming a film can be adjusted by drawing rolls, air wiping, etc.

Moreover, a period of time until washing with water is performed after contacting the acid solution (holding time until washing with water is performed) needs to be 1 to 120 seconds. The reason is based on the following facts. When the period of time until washing with water is performed is lower than 1 second, the pH of the solution increases, and the acid solution is washed away before the Ti oxide layer and the Zn oxide layer are formed, resulting in the fact that an effect of improving sliding performance is not obtained. When the time exceeds 120 seconds, the amount of the oxide layer does not change. The period of time until washing with water is performed after contacting the acid solution is more preferably 1 to 30 seconds.

It should be noted that the oxide layer in the present invention refers to a layer formed of, for example, an oxide and/or a hydroxide containing Zn and Ti as an essential component. It is required that the average thickness of such an oxide layer containing Zn and Ti as an essential component is 10 nm or more on the surface layer of the temper-rolled part and on the surface layer of the non-temper-rolled part. When the average thickness of the oxide layer becomes as thin as 10 nm or lower on the temper-rolled part and the non-temper-rolled part, an effect of reducing sliding resistance becomes insufficient. In contrast, when the average thickness of the oxide layer containing Zn and Ti as an essential component exceeds 200 nm on the temper-rolled part and the non-temper-rolled part, there is a tendency that a film is broken in pressing, and thus the sliding resistance increases and the weldability decreases. Thus, such an average thickness is not preferable. The average thickness is more preferably 10 to 100 nm.

When the hot dip galvannealed steel sheet of the present invention is manufactured, Al needs to be added to a plating bath, and additional elements other than Al are not limited. More specifically, even when Pb, Sb, Si, Sn, Mg, Mn, Ni, Ti, Li, Cu, etc., other than Al are contained or added, the effect of the present invention is not impaired.

Furthermore, even when S, N, Pb, Cl, Na, Mn, Ca, Mg, Ba, Sr, Si, etc., are incorporated into an oxide layer due to the presence of an impurity in a treatment solution used for oxidation treatment or the like, the effect of the present invention is not impaired.

EXAMPLE

Hereinafter, the present invention will be described in more detail with reference to Examples.

On a cold rolled steel sheet having a plate thickness of 0.8 mm, a hot dip galvannealed film according to a routine manner was formed, and furthermore temper rolling was performed. Subsequently, as oxide formation treatment, the resultant was immersed, for 3 seconds, in an aqueous acid solution of 40 g/l of sodium acetate in which the Ti ion concentration and the temperature of the solution were suitably changed. Thereafter, roll drawing was performed to adjust the solution amount. Then, the resultant was held at room temperature in air for 1 to 30 seconds, sufficiently washed with water, and then dried.

Next, the steel sheet produced as described above was measured for the film thickness of the oxide layer on the temper-rolled part and the non-temper-rolled part of a plated surface layer, and simultaneously the friction coefficient was measured as a measure of simply evaluating press-forming properties.

The test results obtained in the above are shown in Table 2. It should be noted that, in Table 2, the condition refer to that a pressing load was 400 kgf and a sample temperature was 25° C. (room temperature) and the condition 2 refer to that a pressing load was 1500 kgf and a sample temperature was 25° C. (room temperature), respectively.

TABLE 2

| Sample No. | Solution pH buffering agent | Solution Ti concentration | Degree of pH elevation | Solution Temperature | Liquid film quantity ($g/m^2$) | Time until washing with water | Oxide film thickness (nm) Pressure controlled part | Oxide film thickness (nm) Pressure not-controlled part | Friction coefficient Condition 1 | Friction coefficient Condition 2 | Remarks |
|---|---|---|---|---|---|---|---|---|---|---|---|
| 1 | — | — | — | — | — | — | 8.3 | 5.6 | 0.167 | 0.351 | Com. Ex. 1 |
| 2 | Sodium | — | 0.24 | 25° C. | 3 | 5 sec. | 23.1 | 9.8 | 0.138 | 0.145 | Com. Ex. 2 |
| 3 | acetate | | | | 3 | 10 sec. | 31.1 | 12.3 | 0.136 | 0.142 | Com. Ex. 3 |
| 4 | 40 g/l | | | | 3 | 30 sec. | 41.9 | 15.6 | 0.130 | 0.136 | Com. Ex. 4 |
| 5 | | 0.1 g/l | 0.27 | 25° C. | 3 | 5 sec. | 27.2 | 13.7 | 0.131 | 0.102 | Example 1 |
| 6 | | | | | 3 | 10 sec. | 38.5 | 22.1 | 0.128 | 0.100 | Example 2 |
| 7 | | | | | 3 | 30 sec. | 59.9 | 36.1 | 0.124 | 0.095 | Example 3 |
| 8 | | 2.4 g/l | 0.28 | 25° C. | 3 | 5 sec. | 35.2 | 18.2 | 0.130 | 0.098 | Example 4 |
| 9 | | | | | 3 | 10 sec. | 49.5 | 23.6 | 0.127 | 0.095 | Example 5 |
| 10 | | | | | 3 | 30 sec. | 75.2 | 43.3 | 0.120 | 0.092 | Example 6 |
| 11 | | 24 g/l | 0.41 | 15° C. | 3 | 5 sec. | 30.8 | 15.2 | 0.135 | 0.095 | Example 7 |
| 12 | | | | | 3 | 10 sec. | 41.2 | 20.6 | 0.133 | 0.093 | Example 8 |
| 13 | | | | | 3 | 30 sec. | 55.9 | 27.6 | 0.132 | 0.092 | Example 9 |
| 14 | | | | 25° C. | 3 | 5 sec. | 9.5 | 8.2 | 0.165 | 0.159 | Com. Ex. 5 |
| 15 | | | | | 3 | 10 sec. | 20.2 | 10.9 | 0.126 | 0.095 | Example 10 |
| 16 | | | | | 3 | 30 sec. | 42.5 | 25.9 | 0.125 | 0.090 | Example 11 |
| 17 | | | | | 3 | 5 sec. | 53.6 | 42.3 | 0.122 | 0.089 | Example 12 |
| 18 | | | | | 3 | 10 sec. | 54.4 | 49.5 | 0.121 | 0.081 | Example 13 |
| 19 | | | | | 3 | 30 sec. | 85.6 | 52.0 | 0.118 | 0.076 | Example 14 |
| 20 | | | | | 5 | 5 sec. | 38.6 | 20.2 | 0.129 | 0.092 | Example 15 |
| 21 | | | | | 5 | 10 sec. | 50.2 | 36.2 | 0.129 | 0.090 | Example 16 |
| 22 | | | | | 5 | 30 sec. | 70.9 | 38.8 | 0.126 | 0.085 | Example 17 |
| 23 | | | | 50° C. | 3 | 5 sec. | 43.5 | 28.9 | 0.124 | 0.085 | Example 18 |
| 24 | | | | | 3 | 10 sec. | 60.1 | 33.5 | 0.122 | 0.082 | Example 19 |
| 25 | | | | | 3 | 30 sec. | 95.5 | 46.5 | 0.117 | 0.079 | Example 20 |
| 26 | | | | 75° C. | 3 | 5 sec. | 46.9 | 29.2 | 0.123 | 0.082 | Example 21 |
| 27 | | | | | 3 | 10 sec. | 62.3 | 37.2 | 0.119 | 0.078 | Example 22 |
| 28 | | | | | 3 | 30 sec. | 98.5 | 53.3 | 0.115 | 0.076 | Example 23 |
| 29 | | 50 g/l | 0.49 | 25° C. | 3 | 5 sec. | 33.2 | 16.2 | 0.124 | 0.079 | Example 24 |
| 30 | | | | | 3 | 10 sec. | 68.3 | 41.2 | 0.120 | 0.075 | Example 25 |
| 31 | | | | | 3 | 30 sec. | 99.3 | 73.2 | 0.118 | 0.073 | Example 26 |

The following matters are clarified from the test results shown in Table 2.

Since Sample No. 1 of Comparative Example was not treated with an acid solution, an oxide film sufficient for improving the sliding performance is not formed on the temper-rolled part and the non-temper-rolled part, and the friction coefficient is high also under the condition 1 in which the contact pressure is low. Moreover, under the condition 2 in which the contact pressure is high, the friction coefficient further increases and mold galling occurs.

Samples No. 2 to 4 of Comparative Examples are comparative examples which were treated with an acid solution but in which a bath containing no Ti ions was used. In this case, an oxide layer containing Zn as a main component is formed mainly on the temper-rolled part on the surface of a plated steel sheet. Therefore, an effect of improving the friction coefficient under the condition 1 is observed in which the contact pressure is low and thus the contact with a die occurs mainly on the temper-rolled part at the time of forming. However, the friction coefficient is high under the condition 2 in which the contact pressure is high and thus the contact with the die occurs over the temper-rolled part and the non-temper-rolled part.

In contrast, Samples No. 5 to 31 are examples using a bath containing Ti ions. In this case, in the examples of the present invention, excluding Sample No. 14 which was washed with water without holding, a hard oxide layer containing Zn and Ti is formed on the temper-rolled part and the non-temper-rolled part on the surface of a plated steel sheet. Therefore, the friction coefficient is stable at a low level also under the condition 2 in which the contact pressure is high in addition to the condition 1 in which the contact pressure is low.

Samples No. 5 to 7 are examples of the present invention which were treated with an acid solution containing Ti ions, and the friction coefficient decreases also in the condition 2 in which the contact pressure is high in addition to the condition 1 in which the contact pressure is low.

Moreover, Samples No. 8 to 10, 16 to 18, and 29 to 31 are examples of the present invention in which the Ti ion concentration was increased under the same treatment conditions as in Samples No. 5 to 7. Under any conditions, the friction coefficient is stable at a low level.

Samples No 14 to 19 are examples of the present invention in which an acid solution film was formed on the surface of a steel sheet and the period of time until washing with water was performed was changed. In Sample No. 14 of the comparative example in which washing with water was performed without holding, an oxide film sufficient for improving the sliding performance is not formed on the temper-rolled part and the non-temper-rolled part, and the friction coefficient increases also under the condition 2 in which the contact pressure is high in addition to the condition 1 in which the contact pressure is low. In samples No. 15 to 19 in which the holding time is 1 second, the friction coefficient is stable at a low level.

Samples No. 11 to 13 and 23 to 28 are examples of the present invention in which the temperature of the treatment solution was changed, and an effect of improving the friction coefficient is sufficient also under the condition 2 in which the contact pressure is high in addition to the condition 1 in which the contact pressure is low. However, in Samples No. 23 to 28, the production thereof requires a facility with high heat resistance and the amount of evaporation of the solution increases in the production thereof, which makes it somewhat difficult to control the liquid film quantity.

Samples No. 20 to 22 are examples of the present invention in which the liquid film formation quantity was changed relative to Sample No. 16 to 18. Comparison between the samples having the same holding time until washing with water was performed showed that the pH of the solution is hard to increase and an oxide layer is hard to be formed when the liquid film quantity is 5 $g/m^2$, as compared with the case where the liquid film quantity is 3 $g/m^2$, and thus the friction coefficient is slightly high under the condition 1 in which the contact pressure is low and the condition 2 in which the contact pressure is high.

EMBODIMENT 3

By bringing the temper-rolled hot dip galvannealed steel sheet into contact with an acid solution, holding a state where an acid solution film is formed on the surface of the steel sheet for a given time, washing the resultant with water, and drying the washed substance, an oxide layer can be formed on the plated surface layer. During the process, the oxide layer to be formed contains Zn as a main component, and is formed mainly on the temper-rolled part on the surface of the plated steel sheet. In a hot dip galvannealed steel sheet with a relatively low hardness which is used for automobile exterior panels, the forming load is low. Therefore, a portion which directly contacts the die at the time of press forming is mainly the temper-rolled part on the surface of the plated layer. Thus, by forming the oxide layer on the temper-rolled part on the surface of the plated layer, favorable press-forming properties are obtained. However, under severer conditions in which, for example, the load at the time of press forming is high, the plated surface and the die are brought into contact with each other at a high contact pressure and subjected to sliding. Therefore, even when a Zn oxide layer is present on the surface, the surface of a plated alloy and the die are brought into direct contact with each other to cause adhesion. In such a case, the shearing stress of the plated alloy and the die becomes a large sliding resistance. Here, when Sn metal particles are mixed, the sliding resistance decreases. This is because when a soft Sn is present, the soft Sn is stretched to be spread between the plated surface and the die at the time of sliding to thereby prevent the direct contact therebetween. Since Sn metal has a very low shearing stress, the contact resistance between the die and the plated surface becomes small. It should be noted that Sn needs to be present simultaneously with a Zn oxide layer. For example, even when Sn metal alone is added to a hot dip galvannealed surface, the effect of reducing the contact resistance is achieved. However, since an Sn layer is likely to deform, the Sn layer is easily cut into pieces at the uneven top of the plating and the irregularities of the die, and then the effect disappears in a short time. Therefore, the effect is insufficient. In the present invention, by mixing the Sn metal into the Zn oxide layer, an effect of suppressing the adhesion of a hard Zn oxide having a relatively high melting point is utilized. Moreover, the present invention is designed in such a manner that, by forming Sn metal into particles in place of a layer form, the suppression effect can be demonstrated at a crushed portion. It is also assumed that the Zn oxide has an effect of holding the Sn metal particles on the plated surface.

As described above, in the present invention, by hot dip galvannealing a steel sheet, heating the resultant for further alloying, subjecting the resultant to temper rolling, bringing the resultant into contact with an acid solution, holding the resultant for at least 1 to 120 seconds after completion of the contact, and then washing the resultant with water, Sn ions are incorporated in the acid solution when a Zn oxide layer having a thickness of 10 nm or more is formed on the surface of the hot dip galvanized steel sheet. This is the most important requirement in the present invention.

In order to incorporate Sn ions in the acid solution, it is preferable to contain at least one or more of Sn sulfate, Sn nitrate, Sn chloride, and Sn phosphate as a Sn ion concentration in the range of 0.1 to 50 g/l. When the Sn ion concentration is lower than 0.1 g/l, the amount of the metal particles containing Sn as a main component to be formed is small and an oxide layer mainly containing Zn is formed. Therefore, an effect of improving the press-forming properties when the contact pressure increases may not be sufficiently obtained in some cases. In contrast, when the Sn ion concentration exceeds 50 g/l, the proportion of metal particles containing Sn as a main component to be formed is high, which is effective for improving the sliding performance. However, the metal particles containing Sn as a main component tend to deteriorate the compatibility with adhesives designed for the hot dip galvannealed steel sheet.

It is preferable to use an acid solution exhibiting a pH buffering effect in the pH range of 2.0 to 5.0. This is because when the acid solution exhibiting a pH buffering effect in the pH range of 2.0 to 5.0 is used, dissolution of Zn and formation reaction of the Zn oxide due to reaction between the acid solution and the plated layer sufficiently occur by bringing the steel sheet into contact with the acid solution, and then holding for a given time, and thus an oxide layer can be stably obtained on the surface of the steel sheet. The index of such a pH buffering effect can be evaluated by the degree of pH increase defined by the amount (1) of 1.0 mol/l sodium hydroxide solution required to raise the pH of 1 liter of acid solution from 2.0 to 5.0, and the value may be in the range of 0.05 to 0.5. The reason is based on the following facts. When the degree of pH increase is lower than 0.05, the pH promptly increases and thus the dissolution of zinc sufficient for the formation of an oxide cannot be achieved. Therefore, a sufficient oxide layer may not be formed in some cases. In contrast, when the degree of pH increase exceeds 0.5, the dissolution of Zn is promoted and it takes a long time to form an oxide layer, and moreover the plated layer is seriously damaged, which results in the fact that the original function as a rust preventive steel sheet may be lost. It should be noted that the degree of PH increase is evaluated after an inorganic acid having few buffering properties in the pH range of 2.0 to 5.0 is added to an acid solution whose pH exceeds 2.0 to thereby reduce the pH to 2.0.

Mentioned as the acid solution having pH buffering properties are acetate, such as sodium acetate ($CH_3COONa$); phthalate, such as potassium hydrogen phthalate ($(KOOC)_2C_6H_4$); citrate, such as sodium citrate ($Na_3C_6H_5O_7$) and potassium dihydrogen citrate ($KH_2C_6H_5O_7$); succinate, such as sodium succinate ($Na_2C_4H_4O_4$); lactate, such as sodium lactate ($NaCH_3CHOHCO_2$); tartrate, such as sodium tartrate ($Na_2C_4H_4O_6$); borate; and phosphate. It is preferable to use an aqueous solution containing in such a manner that at least one or more thereof is in the range of 5 to 50 g/l in terms of the content of each component mentioned above. When the concentration is lower than 5 g/l, the pH relatively promptly increases simultaneously with the dissolution of zinc, and thus an oxide layer sufficient for the improvement of the sliding performance cannot be formed. In contrast, when the concentration exceeds 50 g/l, the dissolution of zinc is promoted and it takes a long time to form an oxide layer, and moreover the plated layer is seriously damaged, which results in the fact that the original function as a rust preventive steel sheet may be lost.

It is preferable that the pH of the acid solution be in the range of 0.5 to 2.0. This is because when the pH exceeds 2.0, the deposition (formation of a hydroxide) of Sn ions occurs in the solution, and thus the Sn metal particles cannot be stably given to the surface of the plated steel sheet in some cases. In contrast, when the pH is too low, the dissolution of zinc is promoted, and moreover not only that the plating coating weight decreases but also that the plating film is cracked, resulting in the fact that the separation is likely to occur in processing. Therefore, it is preferable that the pH is 0.5 or more. It should be noted that when the pH of the acid solution is higher than the range of 0.5 to 2.0, the pH can be adjusted with an inorganic acid having no pH buffering properties, such as sulfuric acid.

It is preferable that the temperature of the acid solution be in the range of 20 to 70° C. When the temperature is lower than 20° C., the formation reaction of an oxide layer takes a long time, sometimes resulting in lowering of productivity. In contrast, when the temperature is high, the reaction relatively rapidly progresses, but, on the contrary, treatment unevenness is likely to occur on the surface of the steel sheet. Therefore, it is preferable to control the temperature to be 70° C. or lower.

It should be noted that, in the present invention, when Sn ions are contained in an acid solution to be used, Sn metal particles and a Zn oxide layer excellent in sliding performance can be stably formed. Therefore, even when other metal ions, inorganic compounds, etc., are contained as impurities or intentionally contained in the acid solution, the effect of the present invention is not impaired. In particular, since Zn ions are eluted when the steel sheet and the acid solution are brought into contact with each other, the increase in the Zn concentration of the acid solution is recognized during operation. However, the degree of the concentration of Zn ions does not particularly affect the effect of the present invention.

As described above, on the surface of the plated steel sheet of the present invention, an at least 10 nm thick oxide layer containing metal particles containing Sn as a main component and Zn as an essential component is obtained.

There is no limitation on the method of bringing a hot dip galvannealed steel sheet into contact with an acid solution. Mentioned are a method of immersing a plated steel sheet in an acid solution, a method of spraying an acid solution to a plated steel sheet, a method of applying an acid solution to a plated steel sheet using a spreader roll, etc. It is preferable that the acid solution is finally present on the surface of the steel sheet in the form of a thin liquid film. This is because when the amount of the acid solution which is present on the surface of the steel sheet is large, the following problems arise: even when zinc dissolves, the pH of the solution does not increase, and the dissolution of zinc merely successively occurs; it takes a long time to form an oxide layer; the steel sheet is seriously damaged; and the original function as a rust preventive steel sheet is lost. From the viewpoint described above, adjusting the quantity of the acid solution film to be formed on the surface of the steel sheet be adjusted to 50 g/m$^2$ or lower is preferable and effective. It should be noted that the amount of the solution forming a film can be adjusted by drawing rolls, air wiping, etc.

Moreover, it is preferable that a period of time until washing with water is performed after contacting the acid solution (holding time until washing with water is performed) be 1 to 120 seconds. The reason is based on the following facts. When the period of time until washing with water is performed is lower than 1 second, the pH of the solution increases, and the acid solution is washed away before the Sn metal particles and the Zn oxide layer are formed, resulting in the fact that an effect of improving sliding performance is not obtained. When the time exceeds 120 seconds, the amount of the Sn metal particles and the oxide layer do not change.

It should be noted that the oxide layer in the present invention refers to a layer formed of, for example, an oxide and/or a hydroxide containing Zn as an essential component. It is required that the average thickness of such an oxide layer containing Zn as an essential component is 10 nm or more on the surface layer of the temper-rolled part and on the surface layer of the non-temper-rolled part. When the average thickness of the oxide layer becomes as thin as 10 nm or lower on the temper-rolled part and the non-temper-rolled part, an effect of reducing sliding resistance becomes insufficient. In contrast, when the average thickness of the oxide layer containing Zn as an essential component exceeds 200 nm on the temper-rolled part and the non-temper-rolled part, there is a tendency that a film is broken in pressing, and thus the sliding resistance increases and the weldability decreases. Thus, such an average thickness is not preferable. The average thickness is more preferably 10 to 100 nm.

When the hot dip galvannealed steel sheet of the present invention is manufactured, Al needs to be added to a plating bath, and additional elements other than Al are not limited. More specifically, even when Pb, Sb, Si, Sn, Mg, Mn, Ni, Ti, Li, Cu, etc., other than Al are contained or added, the effect of the present invention is not impaired.

Furthermore, even when S, N, Pb, Cl, Na, Mn, Ca, Mg, Ba, Sr, Si, etc., are incorporated into an oxide layer due to the presence of an impurity in a treatment solution used for oxidation treatment or the like, the effect of the present invention is not impaired.

EXAMPLE

Hereinafter, the present invention will be described in more detail with reference to Examples.

On a cold rolled steel sheet having a plate thickness of 0.8 mm, a hot dip galvannealed film according to a routine manner was formed, and furthermore temper rolling was performed. Subsequently, as oxide formation treatment, the resultant was immersed, for 3 seconds, in an aqueous acid solution of 40 g/l of sodium acetate in which the Sn ion concentration (added as tin sulfate (II)) and the temperature of the solution were suitably changed. It should be noted that the pH of the acid solution was all 1.5. Thereafter, roll drawing was performed to adjust the solution amount. Then, the resultant was held at room temperature in air for 1 to 120 seconds, sufficiently washed with water, and then dried.

Next, the steel sheet produced as described above was measured for the film thickness of the oxide layer on the temper-rolled part and the non-temper-rolled part of a plated surface layer, and simultaneously the friction coefficient was measured as a measure of simply evaluating press-forming properties. The Sn metal given to the Zn oxide layer was evaluated as a mass per unit area by the ICO (Induction Plasma Spectrometry) method.

The test results obtained in the above are shown in Table 3. It should be noted that, in Table 3, the condition 1 refer to that a pressing load was 400 kgf and a sample temperature was 25° C. (room temperature) and the condition 2 refer to that a pressing load was 1500 kgf and a sample temperature was 25° C. (room temperature), respectively.

TABLE 3

| Sample No. | Solution: pH buffering agent | Solution: Sn concentration | Solution: Degree of pH elevation | Solution: Solution Temperature | Liquid film quantity ($g/m^2$) | Time until washing with water | Oxide film thickness (nm): Pressure controlled part | Oxide film thickness (nm): Pressure not-controlled part | Sn addition amount ($g/m^2$) | Friction coefficient*1: Condition 1 | Friction coefficient*1: Condition 2 | Remarks |
|---|---|---|---|---|---|---|---|---|---|---|---|---|
| 1 | — | — | — | — | — | — | 8.3 | 5.6 | 0.0 | 0.167 | 0.351 | Com. Ex. 1 |
| 2 | Sodium | — | 0.24 | 25° C. | 50 | 5 sec. | 23.1 | 9.8 | 0.0 | 0.138 | 0.145 | Com. Ex. 2 |
| 3 | acetate | | | | 50 | 10 sec. | 31.1 | 12.3 | 0.0 | 0.136 | 0.142 | Com. Ex. 3 |
| 4 | 40 g/l | | | | 50 | 30 sec. | 41.9 | 15.6 | 0.0 | 0.130 | 0.136 | Com. Ex. 4 |
| 5 | | 0.1 g/l | 0.28 | 25° C. | 50 | 5 sec. | 25.6 | 10.8 | 0.1 | 0.126 | 0.120 | Example 1 |
| 6 | | | | | 50 | 10 sec. | 32.1 | 12.5 | 0.1 | 0.125 | 0.118 | Example 2 |
| 7 | | | | | 50 | 30 sec. | 40.8 | 16.8 | 0.2 | 0.120 | 0.112 | Example 3 |
| 8 | | 1.2 g/l | 0.30 | 25° C. | 50 | 5 sec. | 25.6 | 10.1 | 0.1 | 0.122 | 0.106 | Example 4 |
| 9 | | | | | 50 | 10 sec. | 33.5 | 13.9 | 0.2 | 0.119 | 0.100 | Example 5 |
| 10 | | | | | 50 | 30 sec. | 45.2 | 17.2 | 0.4 | 0.115 | 0.095 | Example 6 |
| 11 | | 12 g/l | 0.38 | 15° C. | 50 | 5 sec. | 24.8 | 10.1 | 0.1 | 0.123 | 0.075 | Example 7 |
| 12 | | | | | 50 | 10 sec. | 32.1 | 12.2 | 0.5 | 0.120 | 0.073 | Example 8 |
| 13 | | | | | 50 | 30 sec. | 38.2 | 15.1 | 0.8 | 0.116 | 0.072 | Example 9 |
| 14 | | | | 25° C. | 50 | 5 sec. | 8.3 | 6.1 | 0.0 | 0.163 | 0.160 | Com. Ex. 5 |
| 15 | | | | | 50 | 10 sec. | 18.3 | 7.2 | 0.2 | 0.129 | 0.090 | Example 10 |
| 16 | | | | | 50 | 30 sec. | 35.2 | 14.5 | 0.4 | 0.121 | 0.073 | Example 11 |
| 17 | | | | | 50 | 5 sec. | 33.8 | 13.8 | 0.6 | 0.118 | 0.072 | Example 12 |
| 18 | | | | | 50 | 10 sec. | 42.1 | 16.8 | 1.0 | 0.114 | 0.070 | Example 13 |
| 19 | | | | | 50 | 30 sec. | 50.8 | 19.2 | 1.5 | 0.110 | 0.067 | Example 14 |
| 20 | | | | 50° C. | 50 | 5 sec. | 37.9 | 15.1 | 0.4 | 0.118 | 0.071 | Example 15 |
| 21 | | | | | 50 | 10 sec. | 39.2 | 14.8 | 0.6 | 0.116 | 0.070 | Example 16 |
| 22 | | | | | 50 | 30 sec. | 45.8 | 17.2 | 1.1 | 0.110 | 0.069 | Example 17 |
| 23 | | | | 75° C. | 50 | 5 sec. | 39.2 | 15.2 | 0.5 | 0.117 | 0.070 | Example 18 |
| 24 | | | | | 50 | 10 sec. | 42.1 | 16.1 | 0.7 | 0.114 | 0.069 | Example 19 |
| 25 | | | | | 50 | 30 sec. | 50.1 | 19.2 | 1.3 | 0.112 | 0.067 | Example 20 |
| 26 | | 50 g/l | 0.49 | 25° C. | 50 | 5 sec. | 39.1 | 15.2 | 0.8 | 0.119 | 0.071 | Example 21 |
| 27 | | | | | 50 | 10 sec. | 43.8 | 17.1 | 2.9 | 0.115 | 0.068 | Example 22 |
| 28 | | | | | 50 | 30 sec. | 52.1 | 22.3 | 4.8 | 0.110 | 0.066 | Example 23 |

The following matters are clarified from the test results shown in Table 3.

Since Sample No. 1 of Comparative Example was not treated with an acid solution, an oxide film sufficient for improving the sliding performance is not formed on the temper-rolled part and the non-temper-rolled part, and the friction coefficient is high also under the condition 1 in which the contact pressure is low. Moreover, under the condition 2 in which the contact pressure is high, the friction coefficient further increases and mold galling occurs.

Samples No. 2 to 4 of Comparative Examples are comparative examples which were treated with an acid solution but in which a bath containing no Sn ions was used. In this case, an oxide layer containing Zn as a main component is formed mainly on the temper-rolled part on the surface of a plated steel sheet. Therefore, an effect of improving the friction coefficient under the condition 1 is observed in which the contact with a die occurs mainly on the temper-rolled part at the time of forming and the contact pressure is low. However, the friction coefficient is high under the condition 2 in which the contact with the die occurs over the temper-rolled part and the non-temper-rolled part and the contact pressure is high.

In contrast, Samples No. 5 to 28 are examples using a bath containing Sn ions. In the examples of the present invention, excluding Sample No. 14 which was washed with water without holding, an oxide layer containing Sn metal particles and Zn is present on the surface of the plated steel sheet. Therefore, the friction coefficient is stable at a low level also under the condition 2 in which the contact pressure is high in addition to the condition 1 in which the contact pressure is low.

Samples No. 5 to 7 are examples of the present invention which were treated with an acid solution containing Sn ions, and the friction coefficient decreases also in the condition 2 in which the contact pressure is high in addition to the condition 1 in which the contact pressure is low. Moreover, Samples No. 8 to 10, 16 to 18, and 26 to 28 are examples of the present invention in which the Sn ion concentration was increased under the same treatment conditions as in Samples No. 5 to 7. Under any conditions, the friction coefficient is stable at a low level.

Samples No 14 to 19 are examples of the present invention in which an acid solution film was formed on the surface of a steel sheet and the period of time until washing with water was performed was changed. In Sample No. 14 of the comparative example in which washing with water was performed without holding, an oxide film sufficient for improving the sliding performance is not formed on the temper-rolled part and the non-temper-rolled part, and the friction coefficient increases also under the condition 2 in which the contact pressure is high in addition to the condition 1 in which the contact pressure is low. In samples No. 15 to 19 in which the holding time is 1 second, the friction coefficient was stable at a low level.

Samples No. 11 to 13, 16 to 18, and 20 to 25 are examples of the present invention in which the temperature of the treatment solution was changed, and an effect of improving the friction coefficient is sufficient both under the condition 2 in which the contact pressure is high and under the condition 1 in which the contact pressure is low. However, in Samples No. 20 to 25, the production thereof requires a facility with high heat resistance and the amount of evaporation of the solution increases in the production thereof, which makes it somewhat difficult to control the liquid film quantity.

The invention claimed is:

1. A method of manufacturing a hot dip galvannealed steel sheet, comprising the steps of:

(a) subjecting a steel sheet to hot dip galvanizing to manufacture a hot dip galvanized steel sheet;

(b) heating the hot dip galvanized steel sheet from step (a) for alloying;

(c) subjecting the hot dip galvanized steel sheet from step (b) to temper rolling;

(d) forming an acid solution film on the surface of the steel sheet by bringing the temper-rolled hot dip galvanized steel sheet from step (c) into contact with an acid solution containing ions, at least one of the ions selected from the group consisting of Zr ions, Ti ions, and Sn ions, wherein the acid solution has a pH buffering effect and a degree of pH increase, defined on the basis of an amount of 1.0 mol/l sodium hydroxide solution required to raise the pH of 1 liter of the acid solution from 2.0 to 5.0, is in the range of 0.05 to 0.5;

(e) after completion of the contact in step (d), maintaining a state where an acid solution film is formed on the surface of the steel sheet for at least 1 second; and (f) washing the hot dip galvanized steel sheet from step (e) with water, to thereby form a Zn oxide layer having a thickness of 10 nm or more on the surface of the galvanized steel sheet.

2. The method of manufacturing a hot dip galvannealed steel sheet according to claim 1, wherein the step of forming the acid solution film includes bringing the temper-rolled hot dip galvanized steel sheet into contact with an acid solution containing Sn ions to form an acid solution film on the surface of the steel sheet.

3. The method of manufacturing a hot dip galvannealed steel sheet according to claim 2, wherein the acid solution contains at least one or more of Zn sulfate, Zr nitrate, Zr chloride, and Zr phosphate, in a Zr ion concentration in the range of 0.1 to 50 g/l.

4. The method of manufacturing a hot dip galvannealed steel sheet according to claim 1, wherein the step of forming the acid solution film includes bringing the temper-rolled hot dip galvanized steel sheet into contact with an acid solution containing Ti ions to form an acid solution film on the surface of the steel sheet.

5. The method of manufacturing a hot dip galvannealed steel sheet according to claim 4, wherein the acid solution contains at least one or more of Ti sulfate, Ti nitrate, Ti chloride, and Ti phosphate, in a Ti concentration in the range of 0.1 to 50 g/l.

6. The method of manufacturing a hot dip galvannealed steel sheet according to claim 1, wherein the step of forming the acid solution film includes bringing the temper-rolled hot dip galvanized steel sheet into contact with the acid solution which contains Sn ions to form an acid solution film on the surface of the steel sheet.

7. The method of manufacturing a hot dip galvannealed steel sheet according to claim 6, wherein the acid solution contains at least one or more of Sn sulfate, Sn nitrate, Sn chloride, and Sn phosphate, in an Sn ion concentration in the range of 0.1 to 50 g/l.

8. The method of manufacturing a hot dip galvannealed steel sheet according to claim 1, wherein the acid solution film is in an amount of 50 $g/m^2$ or lower.

9. The method of manufacturing a hot dip galvannealed steel sheet according to claim 1, wherein the acid solution film is in an amount of 0.1 to 30 $g/m^2$.

10. The method of manufacturing a hot dip galvannealed steel sheet according to claim 1, wherein the acid solution contains 5 to 50 g/l of at least one or more of acetate, phthalate, citrate, succinate, lactate, tartrate, borate, and phosphate; the pH of the acid solution is 0.5 to 2.0; and the temperature of the acid solution is 20 to 70° C.

11. The method of manufacturing a hot dip galvannealed steel sheet according to claim 1, wherein the step (d) includes maintaining a state where the acid solution film is formed on the surface of the steel sheet for 1 to 120 seconds after completion of the contact.

12. The method of manufacturing a hot dip galvannealed steel sheet according to claim 11, wherein step (d) includes maintaining a state where the acid solution film is formed on the surface of the steel sheet surface for 1 to 30 seconds after completion of the contact.

13. The method of manufacturing a hot dip galvannealed steel sheet according to claim 1, wherein the Zn oxide layer has an average thickness of 10 to 200 nm.

14. The method of manufacturing a hot dip galvannealed steel sheet according to claim 13, wherein the Zn oxide layer has an average thickness of 10 to 100 nm.

* * * * *

UNITED STATES PATENT AND TRADEMARK OFFICE

CERTIFICATE OF CORRECTION

PATENT NO. : 8,268,095 B2
APPLICATION NO. : 12/226168
DATED : September 18, 2012
INVENTOR(S) : Hiroyuki Masuoka It is certified that error appears in the above-identified patent and that said Letters Patent is hereby corrected as shown below:

Column 25, Line 31;(Claim 2, Line 5):

Delete "Sn" and insert --Zr--.

Signed and Sealed this
Fourth Day of December, 2012

David J. Kappos

David J. Kappos
*Director of the United States Patent and Trademark Office*